United States Patent [19]

Cooper

[11] Patent Number: 4,651,491

[45] Date of Patent: Mar. 24, 1987

[54] ROOFING SYSTEMS

[75] Inventor: Christopher A. Cooper, Maidstone, England

[73] Assignee: Marley Tile AG, Switzerland

[21] Appl. No.: 740,046

[22] PCT Filed: Sep. 26, 1984

[86] PCT No.: PCT/GB84/00329

§ 371 Date: May 14, 1985

§ 102(e) Date: May 14, 1985

[87] PCT Pub. No.: WO85/01539

PCT Pub. Date: Apr. 11, 1985

[30] Foreign Application Priority Data

Sep. 27, 1984 [GB] United Kingdom ..... 8325796

[51] Int. Cl.[4] ..... E04D 1/00

[52] U.S. Cl. ..... 52/534; 52/550

[58] Field of Search ..... 52/534, 533, 550, 551, 52/552

[56] References Cited

FOREIGN PATENT DOCUMENTS

| | | | |
|---|---|---|---|
| 2944697 | 5/1981 | Fed. Rep. of Germany | 52/534 |
| 3118468A1 | 11/1982 | Fed. Rep. of Germany | 52/534 |
| 1518750 | 3/1968 | France | 52/534 |
| 2523186 | 9/1983 | France | 52/534 |

*Primary Examiner*—Carl D. Friedman
*Assistant Examiner*—Naoko N. Slack
*Attorney, Agent, or Firm*—Bacon & Thomas

[57] ABSTRACT

A roofing system includes a weathering member (1) which underlies a ventilating tile (10) having a venilation opening (11). The member (1) includes an aperture (4) which permits air flowing through the tile opening (11) to reach the roof space, the aperture (4) being spaced from the opening (11) and being shielded therefrom by an upstanding ledge (6) of the member. A filler member (20) secured to the underside of the tile (10) engages over the top of the ledge (6) and forms an approximate seal therewith. In an alternative embodiment, the filler member (20) is omitted, and the ledge (6) includes a resilient upper portion which engages directly the underside of the tile.

6 Claims, 5 Drawing Figures

ROOFING SYSTEMS

This invention relates to roofing systems.

In recent years the importance in any roofing system of providing adequate ventilation of the interior roof space has been widely recognised, and experience has shown that in the absence of sufficient ventilation condensation can cause premature deterioration of the rafters and other roof components. Thus, in modern roofing systems various means are generally provided to promote the flow of air from outside the roof to within the interior roof space. For example, in roofing systems comprising tiles, slates or other such individual units it is known to provide a number of so-called ventilating tiles, i.e. a tile provided with one or more ventilation apertures through which air may flow to the interior roof space. Traditionally such tiles usually include a protective eyebrow shaped hood which overlies the ventilation aperture to prevent the direct entry of rain water into the roof space, and a grill or mesh typically covers the lower, open end of the hood which might otherwise provide access into the roof space for birds or insects.

However a problem with ventilating tiles is that airborne water droplets or fine snow flakes may be carried by the airstream into the roof space via the tile ventilation apertures, a grill or mesh generally being ineffective to collect such droplets, and over a period of time this can result in a considerable amount of moisture entering the roof space. This is undesirable and again can cause premature deterioration of the roof components.

Viewed from a first aspect the invention provides a roofing system including a weathering member which underlies a tile, slate or like unit having a ventilation opening, said member having an aperture which permits air flowing through said ventilation opening to enter the underlying roof space, said aperture being spaced from the ventilation opening and being shielded therefrom by an upstanding ledge of said member.

In a roofing system in accordance with the invention, the weathering member aperture permits air flowing through the tile ventilation opening to enter the roof space. However, any airborne water droplets or snow flakes impinge either directly on the weathering member or on the upstanding ledge which shields the aperture from the ventilation opening, and are thus collected by the member. The weathering member is preferably adapted and arranged to drain water collected thereby onto the upper surface of a tile in the adjacent lower row of the system.

Preferably the weathering member is in the form of a tray which is secured at its upper end to a tiling batten of the system. The trailing edge of the member is preferably contoured to match the shape of the upper surface of a tile in the adjacent lower row and is supported by such tile.

It is desirable that the upstanding ledge forms at least an approximate seal with the underside of the overlying tile or slate, and in one embodiment, at least the upper part of the upstanding ledge is formed of a resilient material such as foam which engages and shapes itself to the underside of the tile and thus forms an approximate seal therewith, regardless of how the tile may be contoured. In an alternative embodiment, where the underside of the overlying tile is contoured, a filler portion may be secured thereto which engages over the upper part of the ledge. Advantageously the weathering member further comprises an upstanding flange which extends around the aperture and forms a kerb which reduces the possibility of water collected by the member running into the roof space. The weathering member may conveniently be formed from a plastics material by a vacuum moulding technique.

Viewed from a second aspect the invention provides a weathering member for a roofing system adapted to underly a tile, slate or like unit having a ventilation opening, said member having an aperture adjacent one end thereof which in use permits air flowing through the tile ventilation opening to enter the roof space, and an upstanding ledge adjacent said aperture adapted in use to shield the aperture from the ventilation opening.

A preferred embodiment of the invention will now be described, by way of example only, with reference to the accompanying drawings, wherein.

Figure 1:
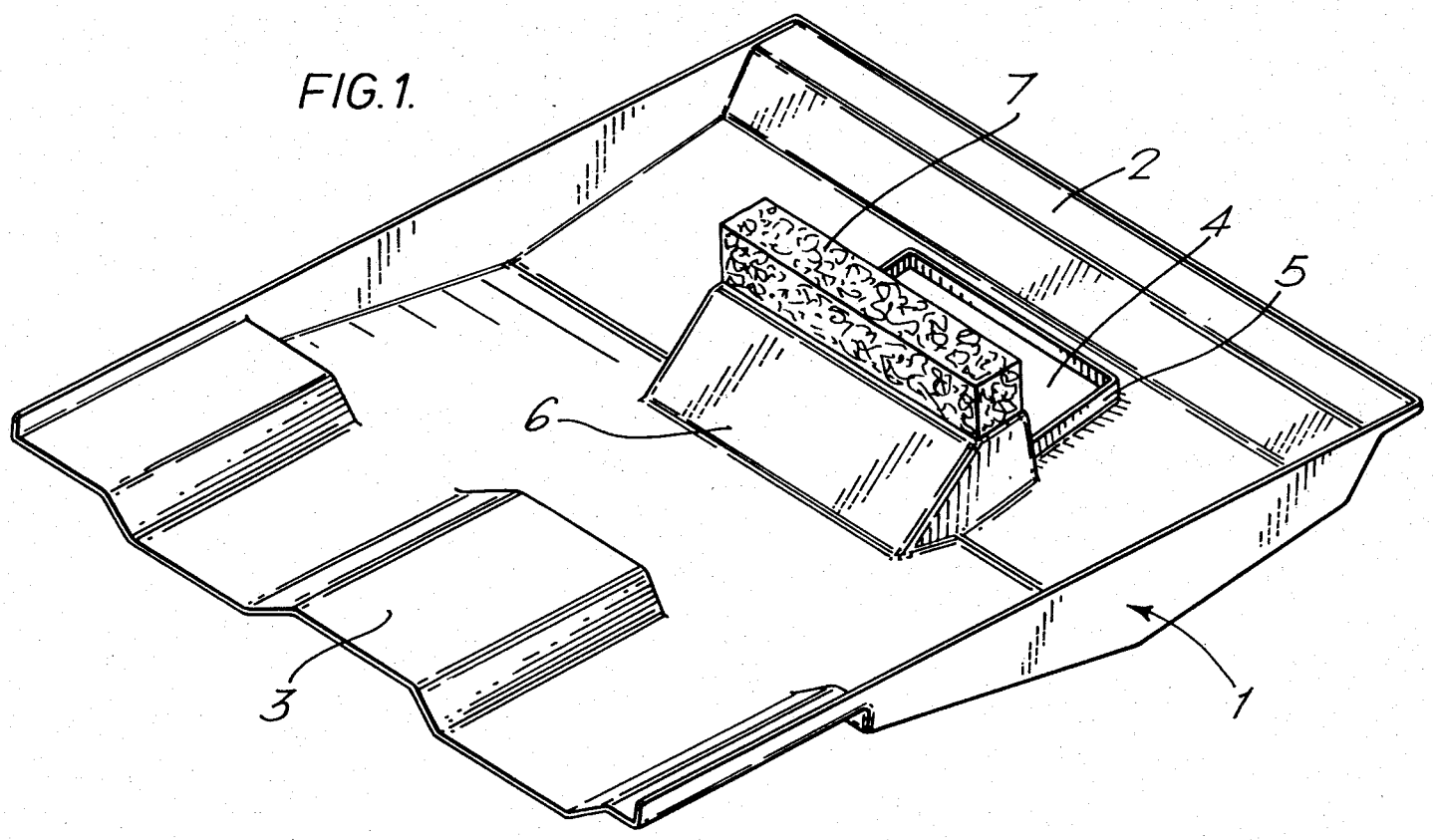
FIG. 1 is a perspective view of a weathering member.

Referring to the drawings, a weathering member 1 formed from a suitable plastics material by a vacuum moulding technique is in the form of a tray having a lip 2 at the upper in use end and a contoured trailing edge 3 which matches the profile of the upper surface of the roof tiles with which the member is adapted for use. The weathering member may be formed from any other suitable material. Adjacent the upper end of the member is formed an aperture 4 around which extends an upstanding flange 5. An upstanding ledge 6 is disposed in front of the aperture 4 and includes an upper part 7 formed of a resilient material.

Figure 2:
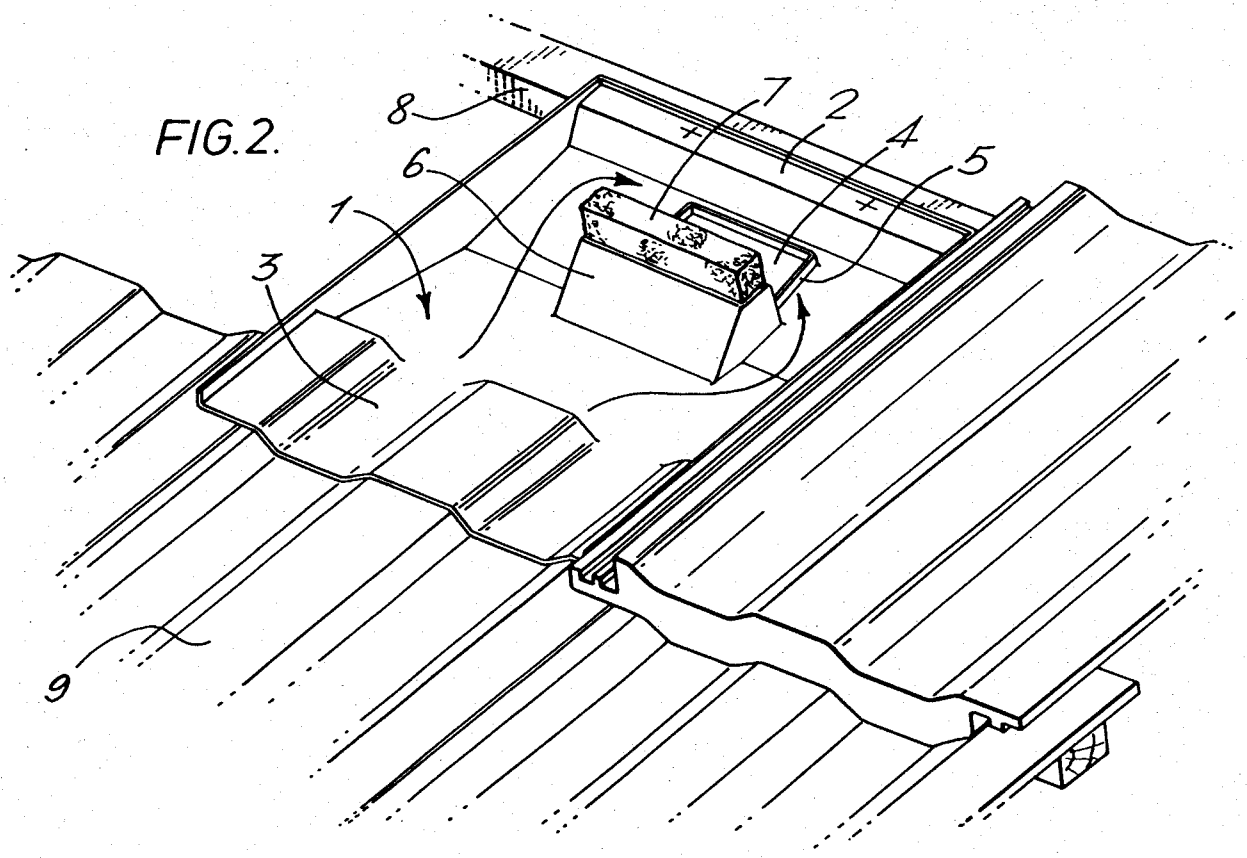
FIG. 2 is a perspective view of part of a roofing system incorporating the weathering member of FIG. 1.

FIG. 2 shows the manner in which the weathering member 1 is secured to a roofing system, the ventilating tile which in use overlies the member being omitted from this figure for clarity. The member 1 is laid in place before the overlying tile, and the lip 2 at the upper end rests on and is secured to e.g. by nailing to a transverse tiling batten 8 of the system. The trailing edge 3 of the member overlaps and rests on the upper surface of an adjacent roof tile 9 in the lower course.

Figure 3:
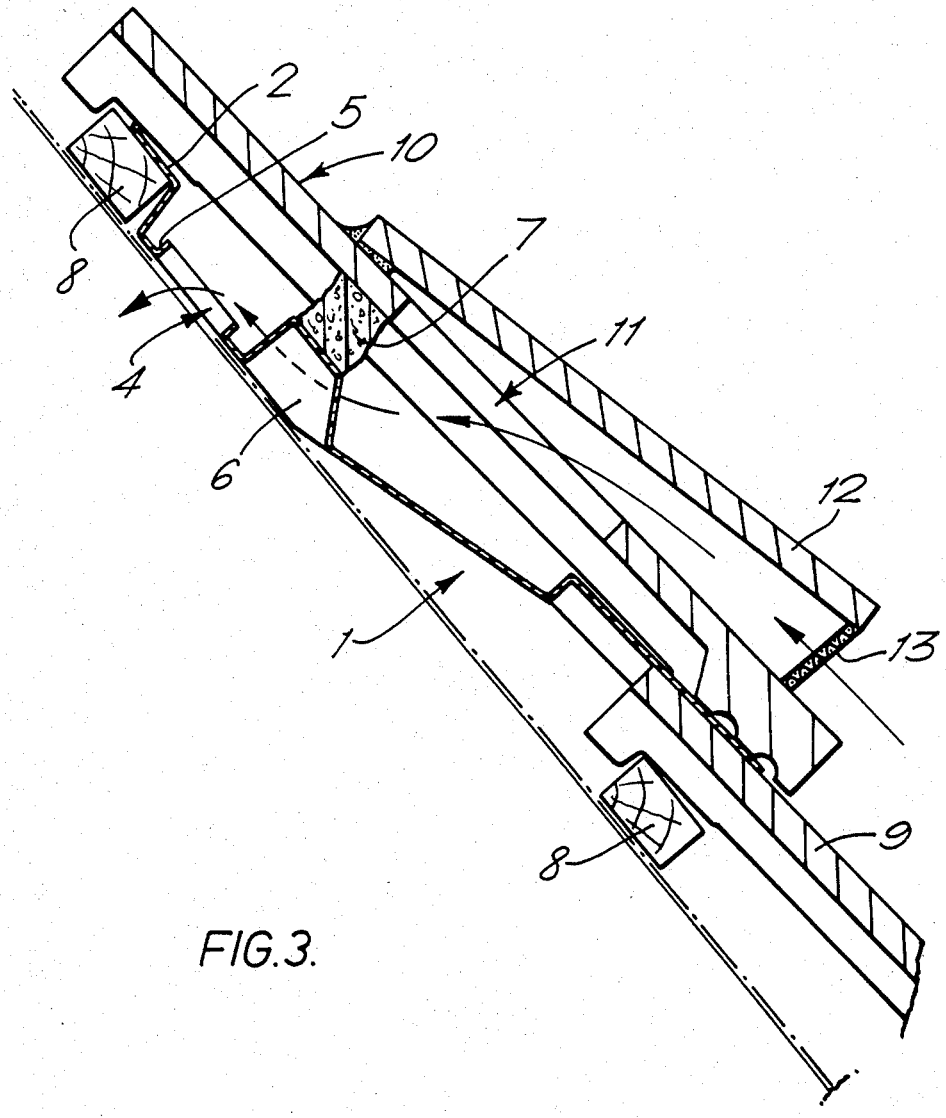
FIG. 3 is a cross-section through part of the roofing system of FIG. 2 showing a ventilating tile overlying the weathering member.

As shown in FIG. 3, a ventilating tile 10 is laid on top of the weathering member, and may be secured by conventional tile clips or nails (not shown). The tile 10 includes a ventilation opening 11 which is covered by an eyebrow shaped hood 12 as is conventional. A grill 13 is provided at the lower, open end of the hood to prevent insects or birds entering the interior roof space. As shown in FIG. 3, the weathering member aperture 4 is spaced from the tile ventilation opening 11 and is shielded therefrom by the upstanding ledge 6. The resilient upper part 7 of the ledge engages the underside of the tile 10 and contours itself to the shape of the tile so as to make an approximate seal therewith.

As shown by the arrows in FIGS. 2 and 3, air flowing through the ventilation opening 11 can flow round the upstanding ledge 6 and enter the roof space via the aperture 4. However, water droplets or snow flakes carried by the airstream will impringe either on the upstanding ledge 6, its resilent upper part 7 or on the weathering member itself. Thus the weathering member collects the liquid droplets or snow flakes and it will be seen that the arrangement is such that the collected liquid runs from the weathering member onto the upper surface of the adjacent lower tile 9. The flange 5 surrounding the aperture 4 further ensures against collected liquid entering the roof space. Where roofing felt underlies the tiles, this is cut adjacent the aperture 4 to enable air to pass into the roof space. As will be seen in particular from FIG. 3, the weathering member is generally in the form of a tray and includes a first generally planar portion in which the aperture 4 is formed extending generally parallel to the rafters, and a second portion which is upwardly inclined relative to the first portion and which rests at its lower end on the upper surface of the lower tile 9.

Figure 4:
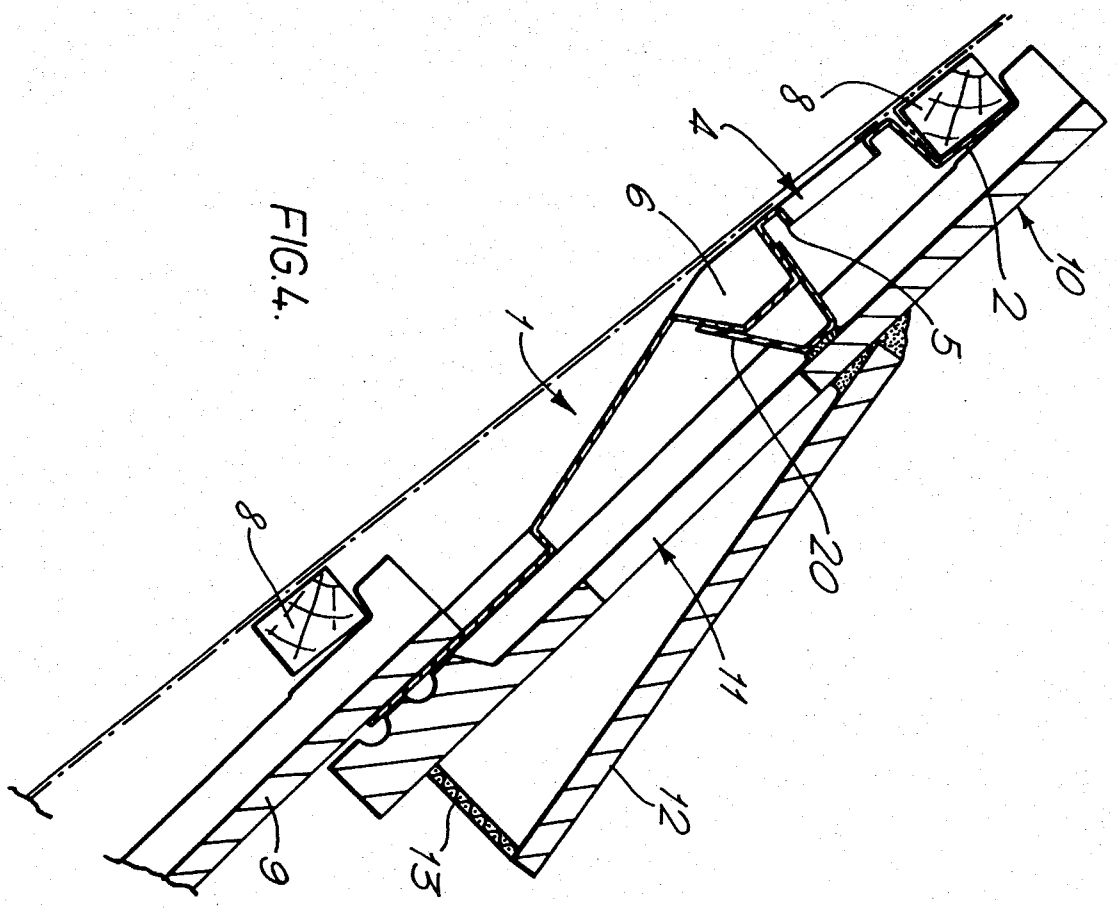
FIG. 4 is a view similar to FIG. 3 only illustrating an alternative embodiment.
Figure 5:
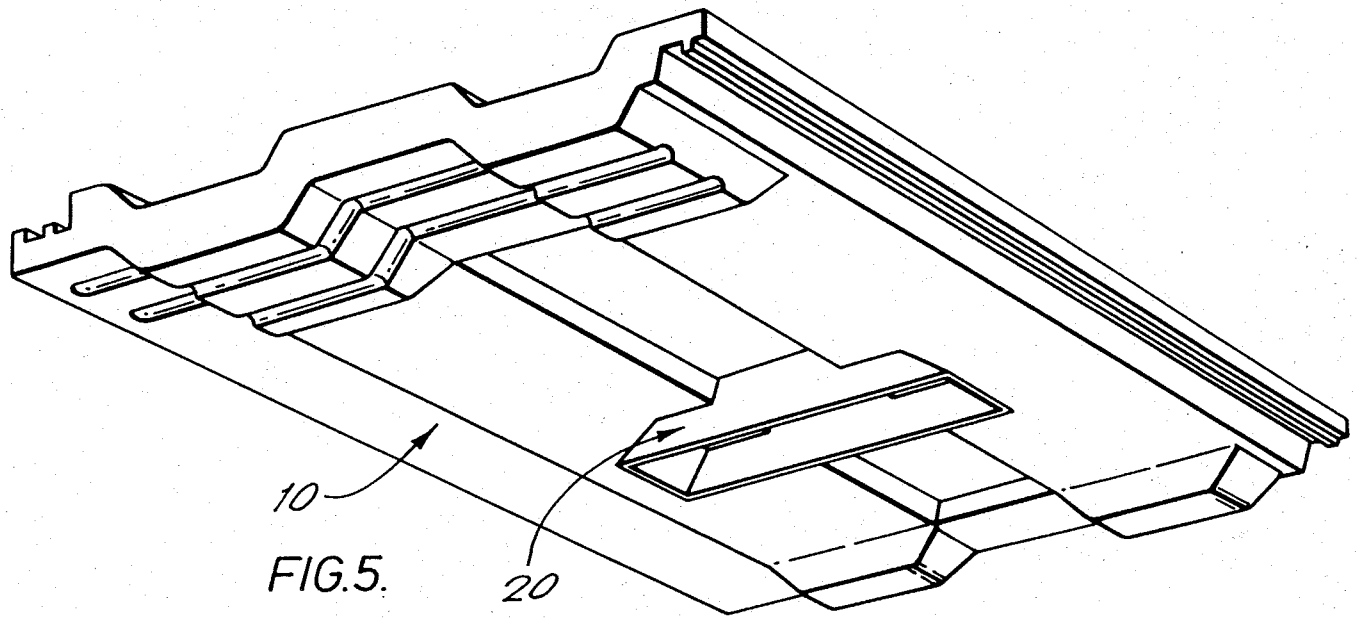
FIG. 5 is a perspective view of the underside of the ventilating roof tile used in the embodiment of FIG. 4.

An alternative embodiment is illustrated in FIG. 4 wherein the resilient upper part of the ledge 6 is omitted and instead the ventilating tile 10 is provided with a filler portion 20 on its underside (FIG. 5). The filler portion 20, which may be vacuum formed from a suitable plastics material and secured to the tile by means of a suitable adhesive, engages over the upstanding ledge 6 of the weathering member 10 and thus prevents water passing over the ledge into the aperture 4.

I claim:

1. A weathering member for underlying a roofing unit having a ventilation opening in a roofing system, such member being of tray like configuration and comprising:

(a) a base part having side edges;

(b) two side walls attached to and extending along side edges of the base part, the two side walls defining a lateral distance therebetween;

(c) an aperture defined in said base part adjacent one end thereof, the aperture extending laterally only part way of the lateral distance between said side walls; and (d) an upstanding ledge attached to the base part and located in front of the aperture, the upstanding ledge extending laterally a distance beyond the aperture on either side thereof, but less than the lateral distance between the side walls so as to defined air passages between the ledge and the side walls such that, in use, the aperture is shielded from the ventilation opening in the overlying roofing unit and air passing through the opening can flow around either side of the ledge and thereby into the underlying roof space.

2. In a roofing system comprising a plurality of individual roofing units arranged in partially overlapping rows thereof, at least one of said units having a ventilation opening for providing ventilation of an underlying roof space, the improved tray like weathering member located beneath said one roofing unit, comprising:

(a) a base part having side edges;

(b) two side walls attached to and extending along side edges of said base part, the two side walls defining a lateral distance therebetween;

(c) an aperture defined in said base part adjacent one end thereof, such aperture extending only part way of the lateral distance between said side walls and spaced longitudinally from said ventilation opening in the overlying roofing unit; and (d) an upstanding ledge attached to the base part and located in front of said aperture the upstanding ledge extending laterally a distance beyond the aperture on either side thereof, but less than the lateral distance between the side walls so as to define air passages between the ledge and the side walls such that the aperture is shielded from the ventilation opening by said ledge and air passing through said ventilation opening can flow around either side of the ledge to said aperture and thereby into the underlying roof space.

3. A roofing system as claimed in claim 2 further comprising means to secure the tray at an upper end to a tiling batten or like supporting member of the roofing system.

4. A roofing system as claimed in claim 3 wherein an end portion of the base part is contoured to match the shape of the upper surface of a roofing unit in an adjacent lower row and is supported by such unit.

5. A roofing system as claimed in claim 2 further comprising a resilient material attached to an upper part of said upstanding ledge of the weathering member so as to engage the underside of the overlying roofing unit.

6. A roofing system as claimed in claim 2 further comprising a filler portion secured to the underside of the overlying roofing unit which engages over the upstanding ledge of the weathering member.

* * * * *